United States Patent [19]

Carrillo

[11] 4,449,845

[45] May 22, 1984

[54] SCREED BOARD APPARATUS

[76] Inventor: Ernest V. Carrillo, 597 W. Gary Dr., Chandler, Ariz. 85224

[21] Appl. No.: 310,504

[22] Filed: Oct. 13, 1981

[51] Int. Cl.[3] ..... E01C 19/22; E04G 21/10

[52] U.S. Cl. ..... 404/118; 404/97; 15/235.4; 52/749

[58] Field of Search ..... 404/99, 114, 118, 119, 404/120; 15/235.4; 224/252, 253, 255, 267, 268, 271; 30/198, 296 R; 52/749; 173/30

[56] References Cited

U.S. PATENT DOCUMENTS

| | | | |
|---|---|---|---|
| 1,220,986 | 3/1917 | Henderson | 404/118 X |
| 1,600,027 | 9/1926 | Welsand | 224/251 X |
| 2,586,472 | 2/1952 | McKown | 404/97 X |
| 2,897,735 | 8/1959 | Alessio | 404/118 |
| 3,067,656 | 12/1962 | Gustafsson | 404/118 X |
| 3,082,460 | 3/1963 | Haivala | 15/235.4 |
| 3,090,984 | 5/1963 | Dunnigan | 15/235.4 |
| 3,095,789 | 7/1963 | Melvin et al. | 404/114 |
| 3,374,717 | 3/1968 | Reynolds, Jr. | 404/118 X |
| 3,453,732 | 7/1969 | Wilkin | 30/296 R |

FOREIGN PATENT DOCUMENTS

| | | | |
|---|---|---|---|
| 173454 | 11/1960 | Sweden | 404/118 |
| 352485 | 4/1961 | Switzerland | 404/114 |

*Primary Examiner*—Ernest R. Purser
*Assistant Examiner*—Beverly E. Hjorth
*Attorney, Agent, or Firm*—H. Gordon Shields

[57] ABSTRACT

Screed board apparatus includes a harness to secure the apparatus to a user and handles to allow the user to move the screed board.

7 Claims, 8 Drawing Figures

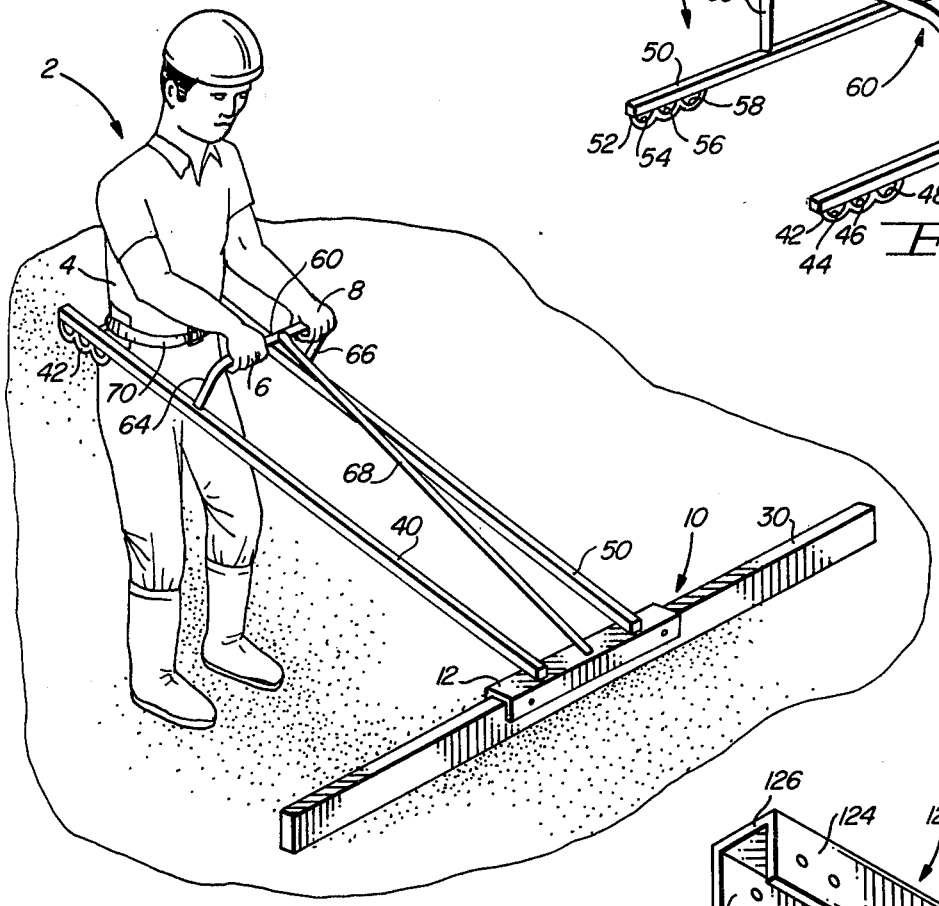
FIG. 1
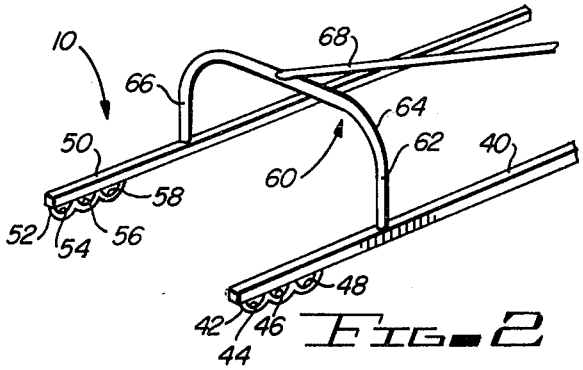
FIG. 2
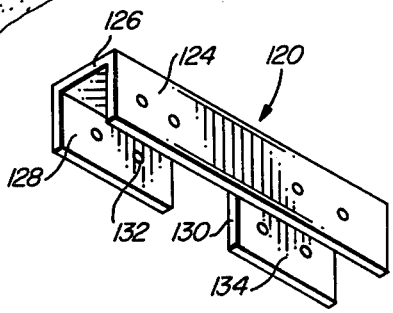
FIG. 8
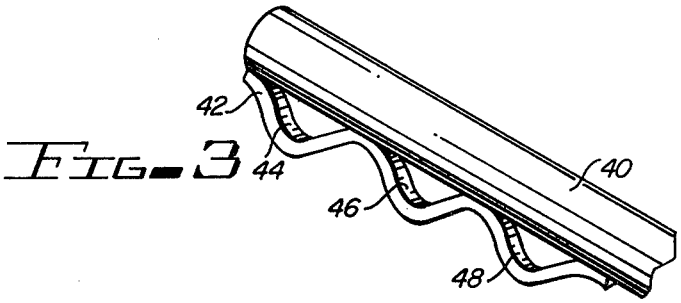
FIG. 3
FIG. 4
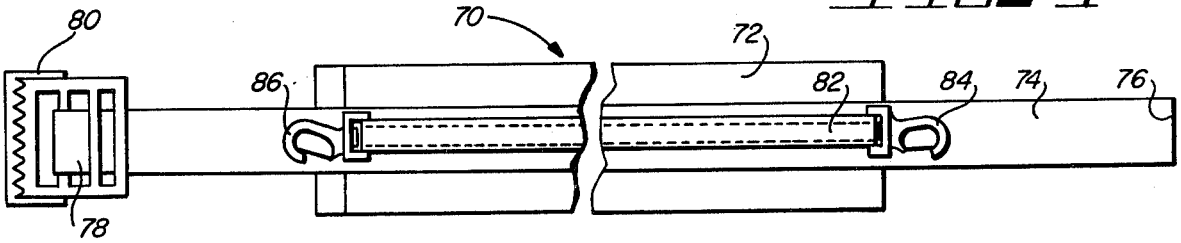

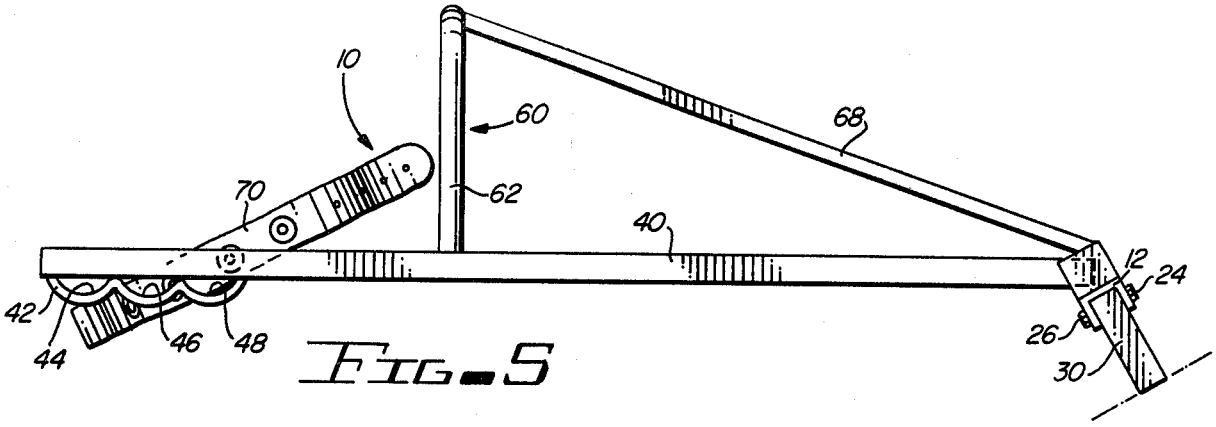
FIG. 5
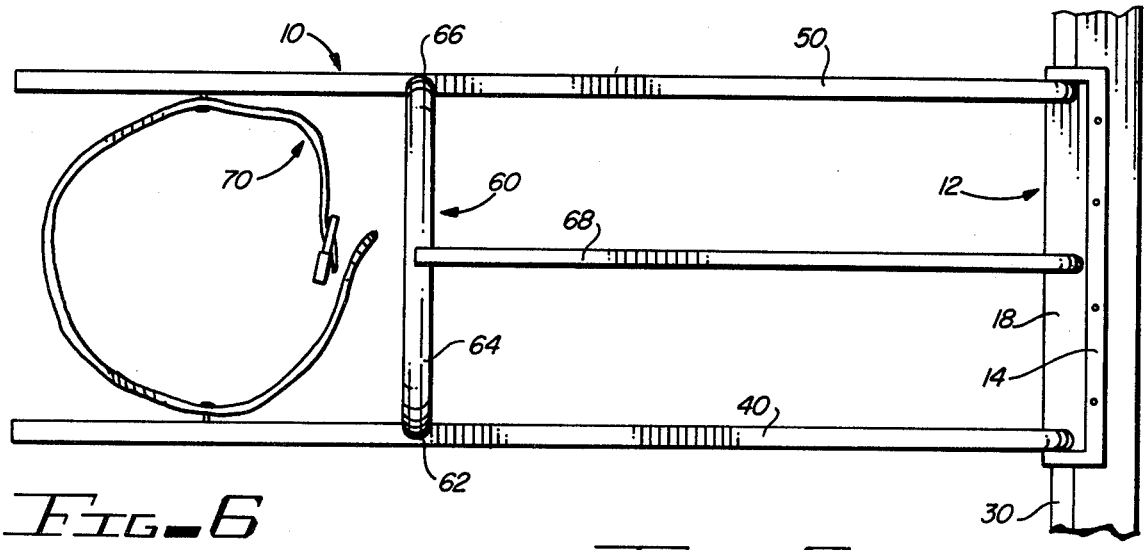
FIG. 6
FIG. 7
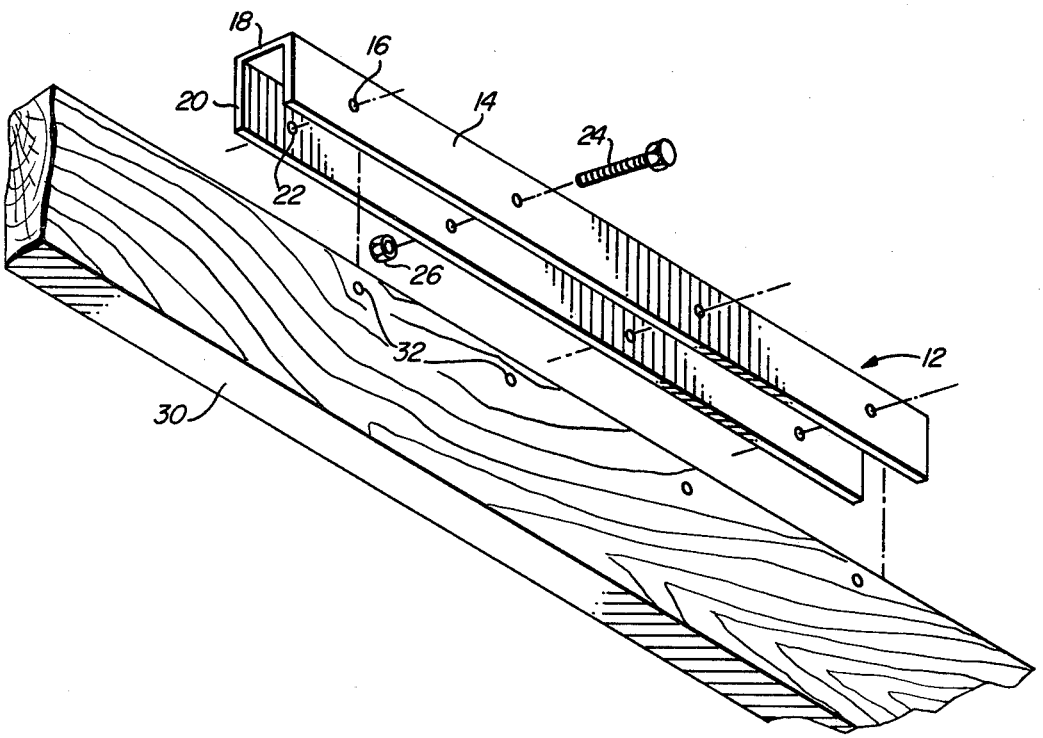

SCREED BOARD APPARATUS

BACKGROUND OF THE INVENTION

1. Field of the Invention

This invention pertains to screed board apparatus, and more particularly, to screed board apparatus used by a single individual, with the screed board harnessed to the individual and movable by the individual.

2. Description of the Prior Art

A screed board is used in cement finishing work for leveling freshly poured concrete. If the area of the concrete is relatively narrow, a screed board, which is usually simply a relatively long, straight, board, may be operated by two individuals who place the board on the concrete forms and move the board back and forth along the forms to level the concrete after it has been freshly poured.

For concrete pours in an area longer or wider than may be screeded in the manner discussed in the preceding paragraph, other types of screed board systems have been developed. One such screed system is disclosed in U.S. Pat. No. 4,030,873. The apparatus of the U.S. Pat. No. 4,030,873 patent discloses a structural frame which utilizes a motor (or motors) secured to the frame for vibration purposes. The frame system is disposed on the concrete forms, and is pulled by a single individual through a harness or cable system.

Other types of screed systems have been developed over the years, such as is found in U.S. Pat. No. 1,220,986. The U.S. Pat. No. 1,220,986 patent discloses a screed board having a pair of handles secured to each end of the board. The apparatus is designed to be placed on forms and moved along the top of the forms by workers at each end of the board holding the handles.

Another type of screed apparatus is disclosed in U.S. Pat. No. 2,813,466, which discloses a screed having a single handle secured to the screed board and extending away from the screed board, plus a plurality of handles or hand grips on the screed board itself. Several men are used to move the screed board, with one man gripping the single handle, while other men grip the screed board directly through the hand grip.

U.S. Pat. No. 2,897,735 discloses another type of screed board which includes a pair of handles secured to the board and a chain securing the board to a belt on a user. The user holds the handles to position or move the screed board, with a substantial part of the movement of the screed coming through the chain linkage secured to him. Springs extend between the screed board and the handles to allow a vibrating motion of the screed board by movement imparted by the user.

U.S. Pat. No. 3,090,984 discloses a tool used for overhead work, such as in plastering, and the like. The apparatus includes a harness secured to the user which supports the primary weight of the apparatus. A pair of handles extends from the overhead tool to the harness. The user of the apparatus guides the tool through the handles while the primary weight of the tool is supported through the harness by the user.

U.S. Pat. No. 2,999,261 discloses a bull float used in cement finishing. The bull float includes a handle secured to the float through a mechanical linkage which automatically adjusts the angle of the board with respect to the handle as the board is pushed and as it is pulled. The angle automatically changes through the mechanical linkage as the user applies force to the handle to push the board and as force is applied to the handle to pull the board, thus maintaining a proper angular orientation between the board and the concrete which is to be worked by the board.

U.S. Pat. No. 3,046,856 discloses a cement tamping tool which includes handles extending upwardly from the body of the tool. The handle is fixed to the tool to maintain a fixed orientation between the handle and the tool which allows the user to pick the tool up, off the concrete, and to push the tool back downwardly, onto the concrete, in the tamping process.

It will be noted that, with respect to the screed boards disclosed in the above-discussed patents, none of them includes a solid linkage between the user and the board that allows the user to both push and pull the board with his body while at the same time manuevering the board through the solid linkage between himself and the screed board.

SUMMARY OF THE INVENTION

The invention described and claimed herein comprises screed board apparatus having a rigid handle secured to the screed board and a flexible harness secured to the rigid handle and secured to a user of the apparatus for pushing and pulling the apparatus and a handle grip secured to the handle and usable by the user for adjusting the screed board with respect to its vertical movement and its angular orientation with respect to a concrete pour that the apparatus is being used to work.

Among the objects of the present invention are the following:

To provide new and useful screed board apparatus;

To provide new and useful screed board apparatus having an elongated handle for guiding the screed board;

To provide new and useful screed apparatus having a harness securable to a user;

To provide new and useful screed board apparatus securable to an individual user for guiding the screed board apparatus; and To provide new and useful screed board apparatus usable by a single individual having a harness and handle secured to a board.

BRIEF DESCRIPTION OF THE DRAWING

FIG. 1 is a perspective view of the apparatus of the present invention in its use environment.

FIG. 2 is a perspective view of a portion of the apparatus of the present invention.

FIG. 3 is an enlarged perspective view of a portion of the apparatus of the present invention.

FIG. 4 is a side view of a portion of the apparatus of the present invention.

FIG. 5 is a side view of the apparatus of the present invention.

FIG. 6 is a top view of the apparatus of the present invention.

FIG. 7 is an exploded lower perspective view of a portion of the apparatus of the present invention.

FIG. 8 is a perspective view of an alternate embodiment of a portion of the apparatus of the present invention.

DESCRIPTION OF THE PREFERRED EMBODIMENT

FIG. 1 is a perspective view of walking screed apparatus 10 of the present invention shown in its use environment secured to a worker 2. The screed apparatus 10 includes a screed bracket 12 to which is secured a screed board 30. A pair of handles 40 and 50 are secured to the screed bracket 12 and extend upwardly at an angle therefrom. A connecting bar 60 is secured between the handles 40 and 50, and a brace 64 extends between the screed bracket 12 and the connecting bar 60.

The worker 2 is shown between the handles 40 and 50, with a belt 70 connected to a pair of belt brackets which are in turn secured to the handles 40 and 50. In FIG. 1, a belt bracket 42 is shown extending beneath, and secured to, the handle 40. A harness 70 is disposed around the waist of the user 2, and the connecting bar 60 is held by hands 6 and 8 of the worker 2. The worker's torso 4 is between the handles 40 and 50, with the worker's waist, the lower portion of the torso, secured to the handles 40 and 50 by the harness 70 at the worker's side.

FIG. 2 is a perspective view of the handles 40 and 50, remote from the screed bracket 12, and illustrating the orientation of the handles 40 and 50, the connecting bar 60, brace 64, the belt bracket 42 on handle 40 and a belt bracket 52 on handle 50. FIG. 3 is an enlarged perspective view of a portion of the handle 40 and its belt bracket 42. FIG. 4 is a side view of the belt 70. FIG. 5 is a side view of the walking screed apparatus 10, and FIG. 6 is a top view of the screed apparatus 10. FIG. 7 is an enlarged exploded view of the screed bracket 12, showing the bracket 12 spaced apart from the screed 30. For the following discussion, reference will generally be made to FIGS. 1 through 7.

The screed bracket 12, best shown in FIG. 7, is a somewhat elongated length of a generally U-shaped piece of metal. It includes a pair of flanges 14 and 20 spaced apart from each other and connected by a top web 18. The bracket 12 is preferably made of steel or aluminum, and is relatively impervious to corrosion, rust, and the like since its use environment is in freshly poured concrete.

The flange 14 includes a plurality of spaced apart holes 16. The flange 20 includes a plurality of spaced apart apertures 22 which are appropriately aligned with the apertures 16 in the flange 14. The holes or apertures 16 and 22 are used to secure a screed board, as the screed board 30, to the bracket 12. A plurality of appropriate fasteners, such as bolt 24 and a nut 26, may be used to secure the screed 30 to the bracket 12. The screed 30 includes a matching plurality of holes or apertures 32 which receive the bolt 24 and which are appropriately aligned with the holes or apertures 16 and 22 and the flanges 14 and 20, respectively.

The screed 30 is shown in FIG. 7, and also in FIGS. 1, 5, and 6, as comprising a wooden board, such as a two-by-four or a two-by-six. However, it will be understood that a metal screed "board" may also be used, if desired. Hence, the term "board" denotes wood, metal, or any other material out of which the appropriate length of screed may be fashioned.

As is well known and understood in the art, the screed may vary in length from about three feet to about twenty feet. Typically, a screed of about fourteen feet for commercial work, or about twenty feet for housing, is used. The difference in length between the various screeds used in industry is primarily dependent upon the slump of the concrete.

With the apparatus of the present invention, a single worker may manipulate screeds of different lengths, as desired, and in accordance with the slump of the concrete, without the need for additional workers. By merely removing one screed 30 and by inserting another screed into the bracket 12, a single bracket, with its handles, may be used with boards of different lengths.

As best shown in FIGS. 5 and 6, the handles 40 and 50 are appropriately secured to the web 18, as by welding. The handles 40 and 50 extend outwardly at an obtuse angle from the screed 30. The handles are accordingly angularly oriented with respect to the web 18 of the bracket 12. The handles 40 and 50 are disposed at an angle to the web 18 of substantially less than 90°, as is also the brace 64.

The connecting bar 60, or cross bar, serves as a handhold for the worker 2 in moving the screed apparatus. The connecting bar or cross bar 60 extends upwardly from the handles 40 and 50, substantially perpendicular thereto. It is of a generally U-shaped configuration, with rounded corners between a pair of vertical legs 62 and 66, and a cross arm or bar 64. The cross bar 64 is actually a handle bar for the user 2, as shown in FIG. 1. The legs 62 and 66 extend vertically, or substantially perpendicularly, from the handles 40 and 50, respectively.

The brace 68 extends from about the center or midpoint of the handle bar 64 to the web 18 of the bracket 12. By grasping the handle bar 64, the user 2 may appropriately maneuver the screed 30 as desired with respect to the freshly poured concrete that is being worked.

For lifting the screed off the concrete, the worker may conveniently grasp the brace 68 with both hands. The screed apparatus 10 pivots at the user's waist, as best understood from referring to FIG. 1. Grasping the brace 68 thus provides a longer level arm for the user than does the handle bar 64.

The belt brackets 42 and 52 are secured to the underneath or bottom portions of the handles 40 and 50, respectively. The brackets 42 and 52 are substantially identical to each other. The belt bracket 42 is best shown in FIG. 3. The bracket 42 includes three loops 44, 46, and 48. The harness 70 may be secured to any one of the three loops, as desired. The considerations for using a specific loop depend on the size, including the height and weight, of the worker 2.

The harness 70, best shown in FIG. 4, includes a fairly wide length of sturdy material, such as nylon, which defines a harness base 72. Secured to the base 72 is a narrower but longer length of similar material which defines the waist or torso encircling belt portion 74. The belt portion 74 includes a pair of ends 76 and 78. The end 78 includes a buckle 80 which receives the end 76 to secure the belt 70 to the user. The buckle 80 is preferably a friction engagement type clasp which requires no holes in the end portion 76, and which accordingly is virtually infinitely adjustable with respect to the end 76 to accommodate workers having torsos (waists) of varying dimensions.

The base portion 72 and the belt portion 74 are appropriately secured together, as by stitching.

The outermost portion of the harness 70 is a strap portion 82 which includes a pair of snap buckles 84 and 86 at its opposite ends. The buckles 84 and 86 swivel or pivot on the ends of the strap 82. The snaps 84 and 86 are received into the appropriate loops in the belt brackets 42 and 52, respectively, to secure the harness 70 to the screed handles 40 and 50 at the user's sides, as shown in FIG. 1.

Loops (not shown) on the ends of the strap portion 82 of the harness 70 allow the snaps 84 and 86 to move in a limited manner to accommodate the workers having various sized waists. Thus, between the variables built into the harness 70 and the loops of the belt brackets 42 and 52, the screed apparatus 10 may be used by workers of varying sizes. As is well known and understood, the snaps 84 and 86 may appropriately swivel as well as move along the loops (not shown) on the strap 82.

The three portions of the harness 70, namely the base 72, the belt 74, and the strap 82, are appropriately all secured together, as by stitching.

The harness 70 is a flexible connecting link between the user 2 and the handles 40 and 50, and through the handles 40 and 50 and the bracket 12, to the screed 30. The harness 70 secures the screed apparatus 10 to the worker 20 in a rigid yet flexible relationship, which allows the user to move freely for pulling and pushing the screed, and yet allows the connection between the user or worker 2 and the screed 10 to be flexible. Pushing and pulling of the screed 30 is accomplished through the harness 70 and the handlebar 64. The direct connections between the user 2 and the screed 30 are rigid, by means of the handles 40 and 50 and of the handlebar 64 and its legs 62 and 66 and the brace 68. Yet the attachment of the handles 40 and 50 to the waist or torso 4 of the user 2 is flexible through the harness 70. The legs and torso of the user 2 provide the primary power through a rigid connection for moving the screed 30 over the freshly poured concrete, and the arms and hands of the user provide the guidance for, and determine the depth of, the screed with respect to the concrete.

To give an idea of relative dimensions, the base 72 of the harness 70 may be about four inches wide, and may be about twenty-four inches long. This allows the widest portion of the harness, the base 72, to be disposed at the user's back and sides. The belt portion 74 may be about two inches wide to provide adequate strength and some degree of support as it encircles the user's torso at the waist. The two-inch width provides a sufficient width for being secured to the base 72 and also provides support for the front, abdominal portion, of the user. The strap 82 may be about one inch in width, sufficient to provide substantial strength in and of itself, and wide enough to permit adequate stitching to secure the strap 82, the belt 74, and the base 72 together to define a single harness 70.

An alternate embodiment of the bracket 12 is shown in FIG. 8. A bracket 120 is shown in FIG. 8 as being similar to the bracket 12, including a pair of flanges 124 and 128 spaced apart from each other and secured to a center web 126. The web 126 includes a relieved portion 130 in its central area.

The web 124 is continuous to provide adequate support for the front of a screed board, such as the screed board 30, to which the bracket 120 may be secured. However, in the interests of weight, and expense, the rear flange 128 may be discontinuous, including the relieved portion, such as the portion 130. The flange 128 accordingly is divided into two portions 132 and 134. Each portion 132 and 134 includes a plurality of holes or apertures, which are aligned with a plurality of holes or apertures in the flange 124 for securing the bracket 120 to a screed, such as the screed 30. The spacing between the flanges 124 and 128 is, of course, substantially identical to the spacing between the flanges 14 and 20 of FIG. 7. Such spacing is the width of a screed board 30 which may be received into the bracket 120 between the flanges 124 and 128.

In use, the harness 70 is secured around the waist of the user 2 after a screed board of appropriate length is secured to the bracket 12. The user 2 then grasps the handlebar or cross bar 64 in the user's two hands. For carrying purposes, the user may grasp the brace 68, if desired, and as discussed above.

After moving into position on freshly poured concrete, the user 2 lowers the screed 30 to the surface of the freshly poured concrete, as shown in FIG. 1. With the user's hands on the cross bar 64, the user maneuvers the screed apparatus as desired to effect the screeding of the concrete as necessary.

With the harness 70 secured to the handles 40 and 50, the user 2 moves the screed with his legs and torso as the user walks to and fro on the concrete. Specific maneuvering of the screed is accomplished by the user's arms through the connecting bar 60. Pressure applied by the user's arms (hands) on the handlebar or crossbar 64 upwardly or downwardly causes the screed to pivot upwardly or downwardly on the pivot points of the handles 40 and 50 at the particular loops of the belt brackets 42 and 52 of the handles 40 and 50, respectively. Lateral movement of the screed 30 is accomplished in substantially the same manner through the coordinated movements of the user's arms and his torso.

Through the securing of the screed 30 to the torso 4 of the user 2, the major force required to move the screed is accomplished through the legs of the user, as opposed to the arms of the user, as in the prior art. The guidance of the screed, and minor maneuvering, is accomplished by the user's arms through the user's hands 6 and 8 secured to the connecting bar 60. Since the user remains in an upright position, as shown in FIG. 1, undue strain on the back is obviated, which strain would otherwise be required if the user were required to bend over, as with screeds of the prior art.

While the connection between the screed apparatus 10 and the user 2 is flexible through the harness 70, the handles 40 and 50 to which the harness 70 is secured remains rigid with respect to the screed 30 and its bracket 12. As illustrated in FIGS. 1, 5, and 6, the handles 40 and 50 are preferably secured, as by welding, directly to the bracket 12. However, if desired, a pivoting relationship between the handles 40 and 50 with respect to the bracket 12 may be employed, using bolts or pins to connect the handles to the bracket in order to adjust to users of different sizes (heights). The employment of the pin or bolts provides a positive, rigid connection between the handles and the bracket which allows the screed 30 and the handles 40 and 50 to move in a unitary manner with the torso 4 of the user 2, as illustrated. However, by using a plurality of loops on the belt bracket secured to each handle, a fixed connection between the handles and the screed bracket 12 may accommodate users of different heights, just as the loops of the belt brackets and the harness belt and strap may accommodate users of various heights and waist measurements.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles.

The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Walking screed apparatus, comprising, in combination:

a screed;

bracket means securable to the screed;

handle means secured to the bracket means, including a first handle, a first leg secured to the first handle and extending upwardly substantially perpendicularly to the first handle, a second handle spaced apart from the first handle, a second leg secured to the second handle and extending upwardly substantially perpendicularly to the second handle, and a bar extending between the first and second legs for holding by a user to maneuver the screed;

a brace secured to and extending between the bar and the bracket means; and flexible harness means secured to the handle means and adapted to be secured to the torso of a user for securing the screed apparatus to the user, and the bar is disposed between the harness means and the bracket means.

2. The apparatus of claim 1 in which the bracket means includes a flange securable to the screed and a web securable to the handle means.

3. The apparatus of claim 1 in which the handle means further includes a first belt bracket secured to the first handle and a second belt bracket secured to the second handle, and the harness means is secured to the first and second belt brackets.

4. The apparatus of claim 3 in which each belt bracket includes a plurality of loops, and the harness means is selectively securable to any loop of the plurality of loops for accommodating users of different sizes.

5. The apparatus of claim 3 in which the bar is secured to the first and second handles between the bracket means and the belt brackets.

6. The apparatus of claim 1 in which the handles are secured to the harness means at the sides of the user.

7. The apparatus of claim 6 in which the legs and the bar is spaced apart from the harness for holding by the user.

* * * * *